US007640711B2

(12) United States Patent
Grove

(10) Patent No.: US 7,640,711 B2
(45) Date of Patent: Jan. 5, 2010

(54) INTERLOCKING CONTINUOUS ROOF ASSEMBLY AND METHOD FOR WIND RESISTANT ROOFING

(76) Inventor: David Grove, 5472 Wellesley St. East, La Mesa, CA (US) 91942

( * ) Notice: Subject to any disclaimer, the term of this patent is extended or adjusted under 35 U.S.C. 154(b) by 32 days.

(21) Appl. No.: 12/001,812

(22) Filed: Dec. 13, 2007

(65) Prior Publication Data

US 2008/0196352 A1 Aug. 21, 2008

Related U.S. Application Data

(63) Continuation-in-part of application No. 11/676,657, filed on Feb. 20, 2007.

(51) Int. Cl.

| | |
|---|---|
| ***E04B 1/08*** | (2006.01) |
| ***E04B 7/00*** | (2006.01) |
| ***B23P 11/00*** | (2006.01) |
| ***F24F 7/02*** | (2006.01) |

(52) U.S. Cl. ..... 52/748.1; 52/57; 52/528; 52/198; 52/96; 52/94; 29/897.3; 29/505; 29/514; 29/521; 454/365

(58) Field of Classification Search ..... 52/748.1, 52/528, 535, 198, 199, 94, 95, 96, 537, 529, 52/530, 745.06, 746, 57, 46, 47; 454/365; 29/505, 509, 514, 521, 897.3
See application file for complete search history.

(56) References Cited

U.S. PATENT DOCUMENTS

| | | | | | |
|---|---|---|---|---|---|
| 2,258,078 | A * | 10/1941 | Tennison | 52/13 |
| 2,586,318 | A * | 2/1952 | Fields | 52/77 |
| 3,381,426 | A * | 5/1968 | Heidrich | 52/96 |
| 3,511,011 | A * | 5/1970 | Straus | 52/478 |
| 4,112,632 | A * | 9/1978 | Simpson | 52/11 |
| 4,411,120 | A * | 10/1983 | Ellis et al. | 52/748.1 |
| 4,489,532 | A * | 12/1984 | Ellis et al. | 52/748.1 |
| 4,570,404 | A * | 2/1986 | Knudson | 52/520 |
| 5,001,881 | A * | 3/1991 | Boyd | 52/545 |
| RE33,566 | E * | 4/1991 | Heckelsberg | 52/520 |
| 5,022,203 | A * | 6/1991 | Boyd | 52/199 |
| 5,301,474 | A * | 4/1994 | Carey et al. | 52/90.1 |
| 5,355,649 | A * | 10/1994 | Berridge | 52/520 |
| 5,535,567 | A * | 7/1996 | Cahoon | 52/520 |
| 5,584,153 | A * | 12/1996 | Nunley et al. | 52/410 |
| 5,697,197 | A * | 12/1997 | Simpson | 52/462 |
| 6,301,853 | B1 * | 10/2001 | Simpson et al. | 52/520 |
| 6,578,325 | B2 * | 6/2003 | Henderson | 52/199 |
| 6,889,478 | B1 * | 5/2005 | Simpson | 52/520 |
| 6,955,012 | B2 * | 10/2005 | Suzuki | 52/198 |
| 2003/0121217 | A1 * | 7/2003 | Grizenko | 52/60 |
| 2005/0055904 | A1 * | 3/2005 | Greenberg | 52/198 |
| 2005/0193644 | A1 * | 9/2005 | Simpson et al. | 52/91.3 |
| 2005/0246992 | A1 * | 11/2005 | Rood | 52/450 |

* cited by examiner

*Primary Examiner*—Robert J Canfield
*Assistant Examiner*—Babajide Demuren
(74) *Attorney, Agent, or Firm*—Steins & Associates, P.C.

(57) ABSTRACT

An Interlocking Continuous Roof Assembly and Method for Wind Resistant Roofing is presented, whereby continuous double lock seams are used exclusively to join panels together. This roof manufacturing methodology results in a roof that possesses improved resistance to wind and water during storm conditions and thereby decreases the chances of the roof being damaged or destroyed by severe weather.

12 Claims, 12 Drawing Sheets

6
6
8
8
102
108

RIDGE DETAIL

VALLEY DETAIL

RAKE DETAIL

WALL TO SOFFIT FLASHING

ALTERNATE RAKE DETAIL

PLANTATION STYLE

INTERLOCKING CONTINUOUS ROOF ASSEMBLY AND METHOD FOR WIND RESISTANT ROOFING

This application is a continuation-in-part of U.S. patent application Ser. No. 11/676,657, filed Feb. 20, 2007; now pending.

BACKGROUND OF THE INVENTION

1. Field of the Invention

This invention relates to the methods of construction for residential and business building roofs with any pitch, single or split, flat or steep, with a continuous interlocking wind resistant metal membrane.

2. Description of Related Art

Roofing projects where the building design includes a change in the pitch of the roof, a "slope break," present special difficulties for many roofing materials. This is especially true for long-panel metal roofing systems, where such a change in slope will usually require cutting the pan at the slope break, or require the use of two separate roof panels with a flashing at the slope break.

Many different flashing techniques and sealants have been employed by metal roofing installers over time to deal with such a change in roofing angles, with varying degrees of success.

The state-of-the-art flashing techniques often fail in extreme weather conditions when water blown by high winds penetrates flashing details at the ridge cap, valley, fascia, and slope break, because the flashing is not continuous and interlocking. In particular, flashing techniques at slope breaks that rely on sealants to prevent water penetration will fail over time as sealants are weathered and age.

The present invention involves a field-proven technique that will allow the installation of roofing panels and ridge caps onto a roof with a split pitch in a single, continuous length without the need to cut the roofing panel. Roofing panels and ridge caps are installed from ridge to eaves with continuous double-lock standing seams without cuts or seams, thereby creating leak-proof conditions. The continuous nature of the double lock seams is crucial, because joints along the seam would permit water or wind to work on the seam and eventually split it open.

The typical roof in a high wind weather condition is degraded and eventually destroyed because one or more roofing panels and or the ridge cap are lifted off of the structure. When this happens, the entire roof is quickly peeled off of the building and the rest of the building is exposed to the weather. By eliminating the entry of water and wind under the edges of the roof panels and ridge cap, the roof will survive heavy hurricane force winds.

The purpose of this invention is to provide a standard American-style roof with eaves, pitched or flat, straight pitch or split pitch, or plantation style, resistance to winds of extreme force by forming a metal membrane of continuous interlocking flashing. With roofing panels, the present invention will confer resistance to all winds, not depending on thru fasteners or flashing with caulk.

All details of roof split pitch, valley, ridge cap, fascia are unique and new to the roofing industry because roofers have not been equipped to produce continuous panels and all other flashings in one piece, including ridge caps, valleys, soffit flashings, fascia cap, on site.

SUMMARY OF THE INVENTION

In light of the aforementioned problems associated with the prior devices and methods, it is an object of the present invention to provide an Interlocking Continuous Roof Assembly and Method for Wind Resistant Roofing. An objective of the present invention is to provide a methodology for assembling sheet metal roofs in such a manner as to minimize or eliminate leakage and susceptibility of the roof to wind damage.

A further objective of this invention is to make the methodology easy and cost-efficient to use.

A further objective of the present invention is to allow the methodology to be implemented with hand tools or power tools with hand tool finishing.

A further objective of the present invention is to permit all steps of roof manufacture using this methodology to be performed on the roofing job site.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Interlocking Continuous Roof Assembly and Method for Wind Resistant Roofing.

As a preliminary matter, the term "building substrate," as used herein, is intended to refer to the surface that the roof of the present invention is being attached to. The roof portion of the building substrate is generally the outer structural surface of the building roof, but not that part that relates to the weather-proofing of the building. Most times, the building's roof substrate is Oriented Strandboard or the like attached to the building's roof rafters.

Figure 1:
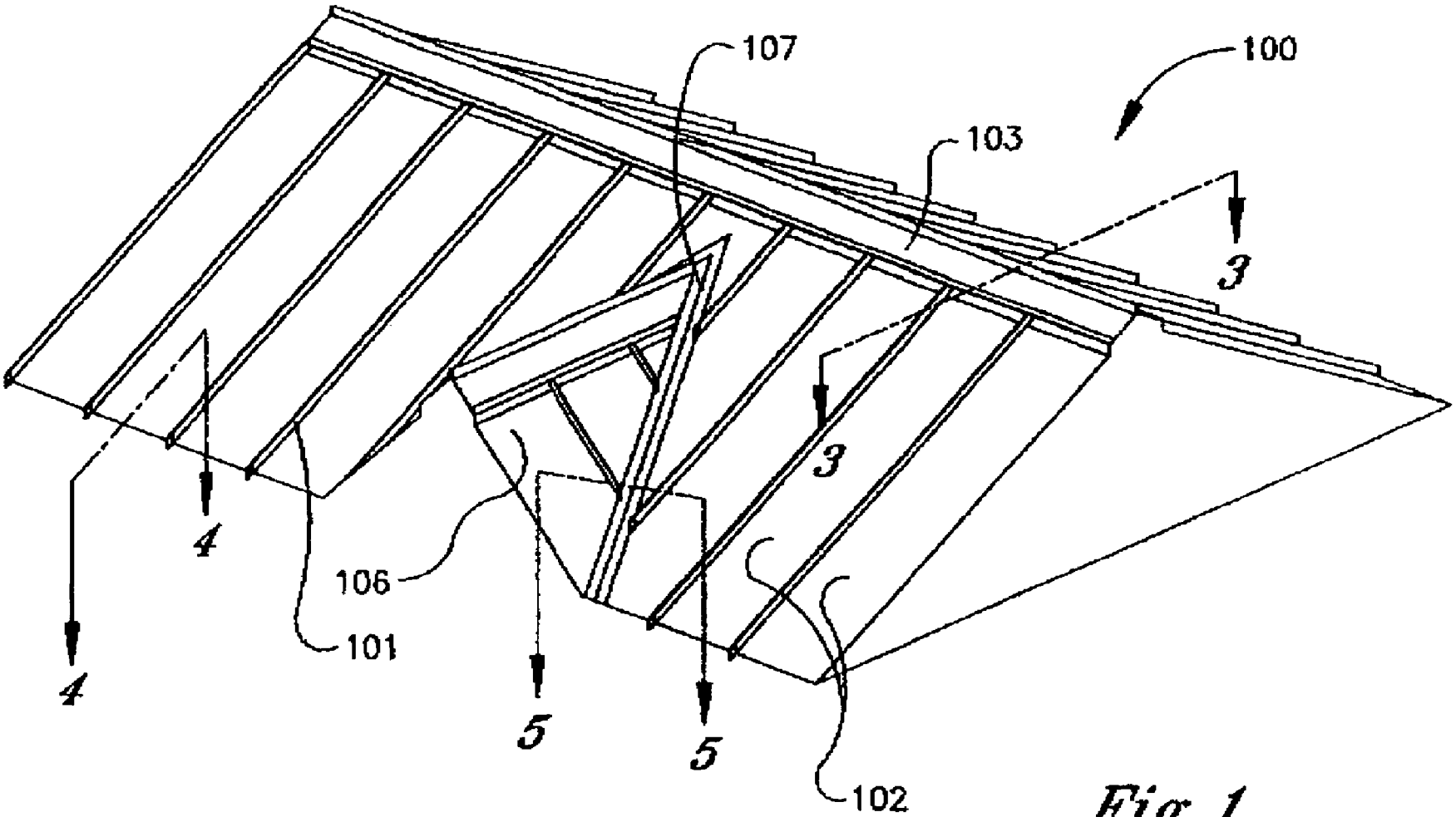
FIG. 1 is a perspective view of a typical pitched roof.

The method implemented by the present invention is intended to make waterproof and windproof seams between roof panels 102 and the roof ridge cap 103, as well as between the individual roof panels 102. The preferred roof ridge cap 103 is comprised of a male 104 and a female lock 105 panel (see FIG. 3). The present method is also used to assemble roofs from collections of roof panels 102 by means of producing double lock seams 115. FIG. 1 shows a typical metal roof 100 with a plurality of roof panels 102 connected with the double-lock roof panel seams 101 of the present invention, and a roof ridge cap 103 also created with the method of the present invention. Also shown is a typical dormer 106 roof with valleys 107.

Figure 2:
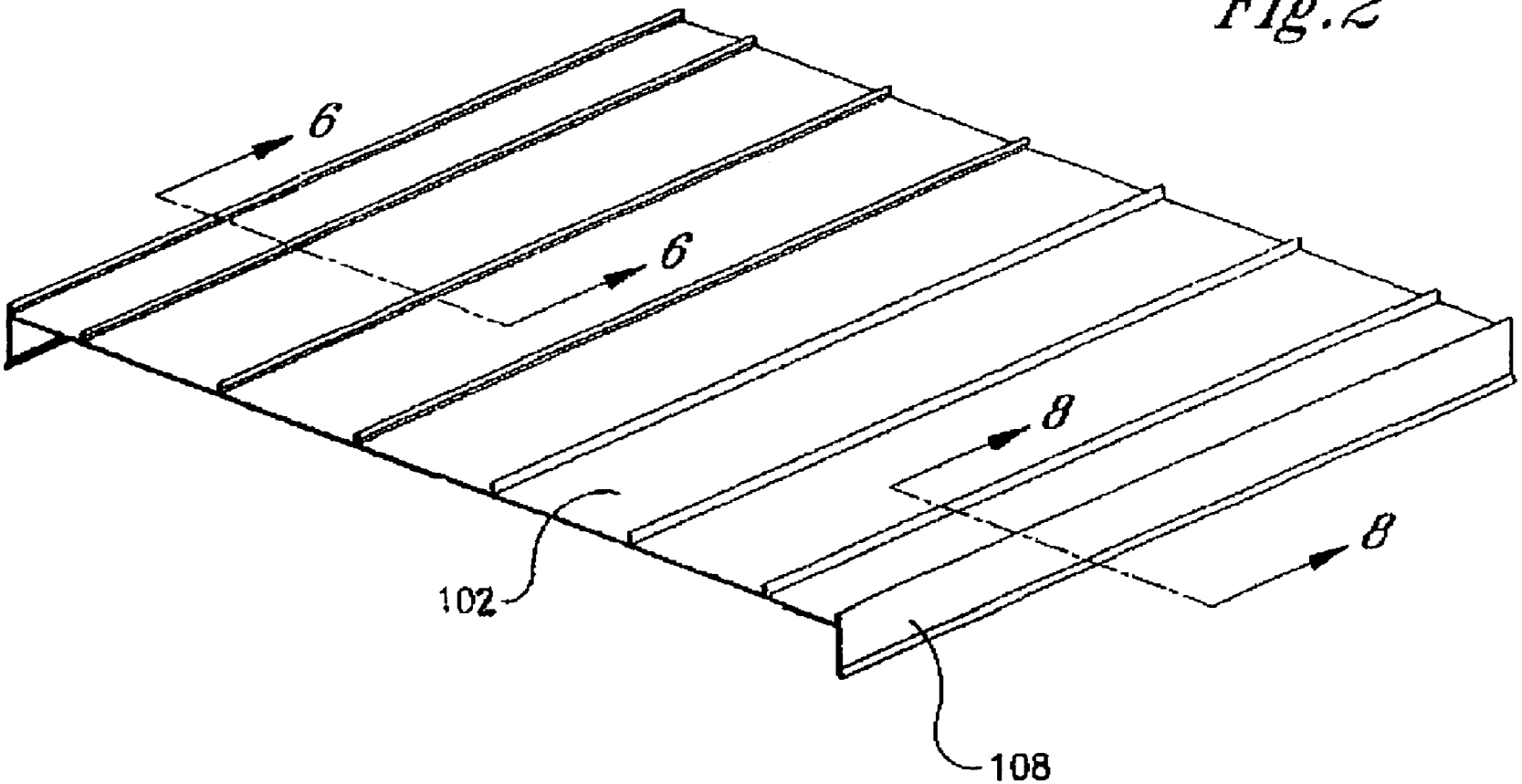
FIG. 2 is a roof panel detail.
Figure 3:
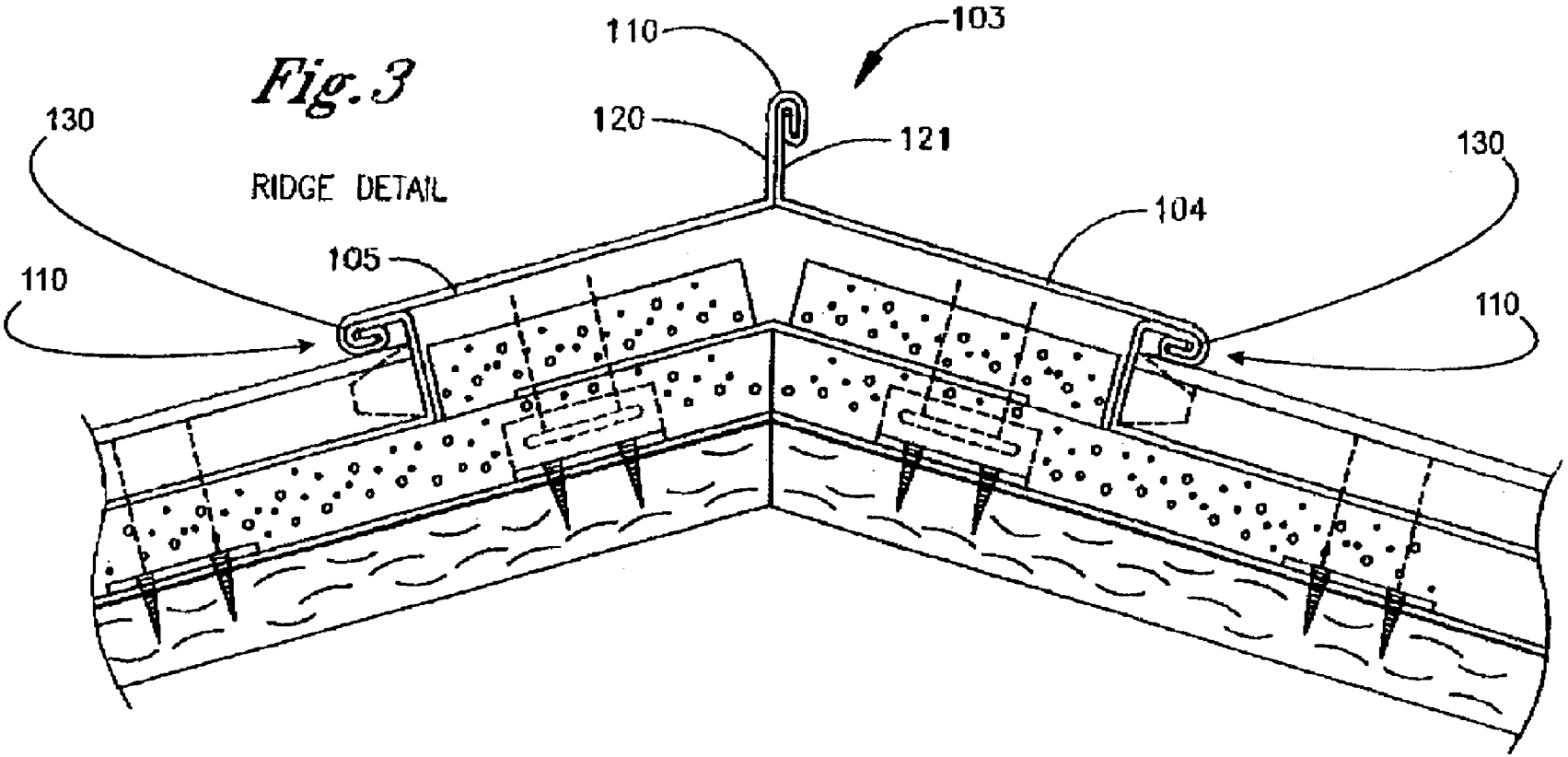
FIG. 3 is a cross-section view of the ridge detail.
Figure 4:
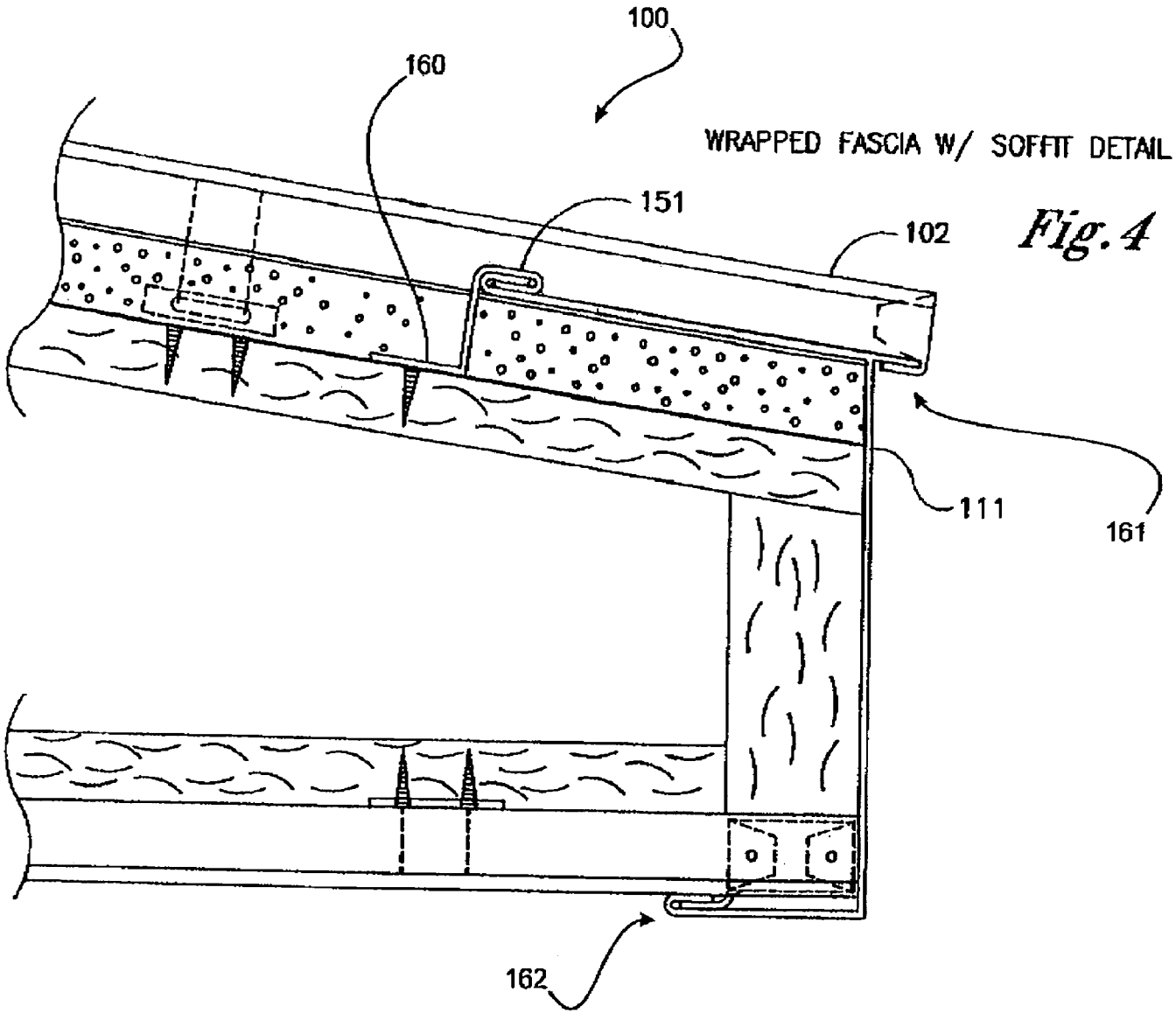
FIG. 4 is a cross-section view of a wrapped fascia and soffit.

FIG. 2 shows a composite roof panel 102 with rake 108. FIG. 3 is a cross-section of the roof ridge assembly. The male lock panel 104 and female lock panel 105 are joined at the top of the roof ridge cap 103 by means of a folded-over double-lock seam 110 formed by folding the mating edge 120 of the female lock panel 105 over the mating edge 121 of the male lock panel 104 to form a single lock seam, and then folding the single lock seam one more time to make a double-lock seam 110.

The length of the male lock panel 104 and female lock panel 105 is indeterminate, and can be of any reasonable length along the ridge of the building. The present invention method includes the step of manufacturing the roof ridge cap 103 on the building site to be as long as necessary to reach from one end of the building roof ridge to the other, comprised of two continuous pieces of metal, the male and female lock panels 104, 105. The next step is to form a double lock seam 110 connecting the male and female lock panels 104, 105 by double folding the mating edges 120, 121 of the lock panels 104, 105.

The width of the male and female lock panels 104, 105, running from the mating edges 120, 121 of the lock panels 104, 105 to where they encounter the mating edges 130 of the roof panels 102, is set by design. Since each roof ridge cap 103 (later referred to as a "ridge assembly") is made from a matched pair of continuous lock panels (104, 105), the ridge cap 103 will be made in a single, continuous piece.

As shown in FIGS. 4, 5A-C, and 6, the method of the present invention can be applied to all areas of the roof 100 where metal roof panels 102 encounter each other or building fascia 111. A fascia clip 160 is first attached to the building substrate. A fascia clip seam 151 is formed between the fascia section 111 and the fascia clip 151. A soffit seam 162 is formed where the fascia section 111 engages a soffit section (is applicable). The pan sections 102 are attached to the fascia section 111 with an eaves seam 161. As should be apparent, all of the roof elements and sections are sealed together to provide a water-proof and supremely wind-resistant building roof.

Figures 5A, 5B, 5C:
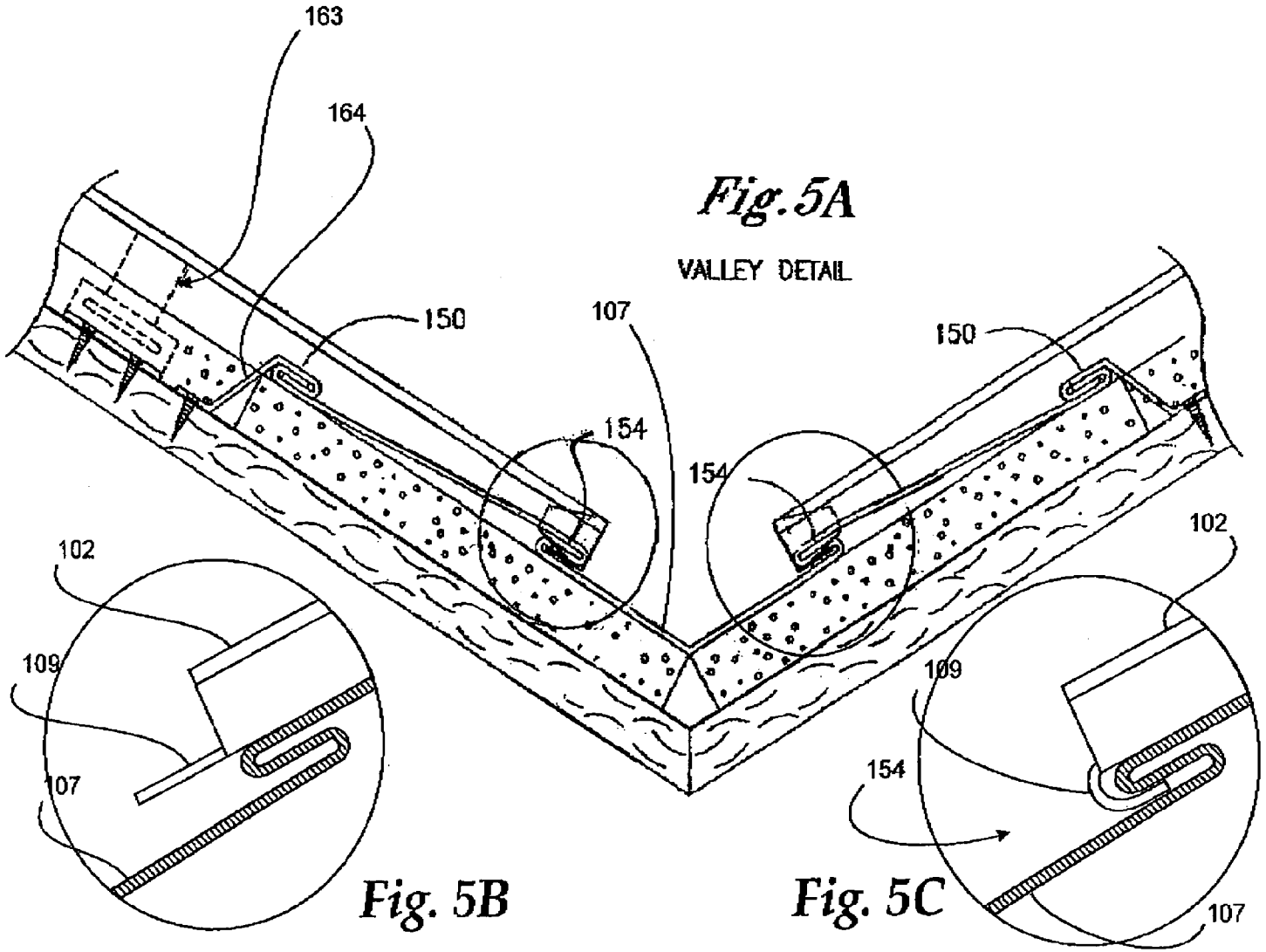
FIGS. 5A, 5B, 5C are cross-sectional views of a roof valley.

FIG. 5A depicts the unique structure related to roofing the valleys using the method of the present invention. A valley section 107 under the present design has two separate seams—one for first attaching the valley section 107 to the building substrate, and another for sealing the valley sections 107 to the intersecting pan sections. Field clips 163 are sealed to the pan sections 102 so that the field/pan sections are attached to the building substrate. Valley clips 164 are attached to the building substrate and then a valley seam 150 is formed between the clips 164 and the valley section 107.

Once all of the pan sections are laid and seamed to the field clips 163, they a valley field pan seam 154 are formed between the valley sections 107 and the pan sections 102 adjacent to the valley section 107.

FIG. 5B is a partial cross-section of the valley section 107, just prior to the formation of the valley field pan seam 154. The pan sections 102 are positioned so that the tongue 109 extends over the Z-bend in the valley section 107. When properly aligned, as depicted in FIG. 5C, the tongue 109 is bent under and into the valley Z-bend to form the seam 154. This seam 154 is hammered flat once formed, and the field pan 102 is pulled away from the seam 154 in order to insure that the field pan 102 is tightly joined to the valley section 107.

Figure 6:
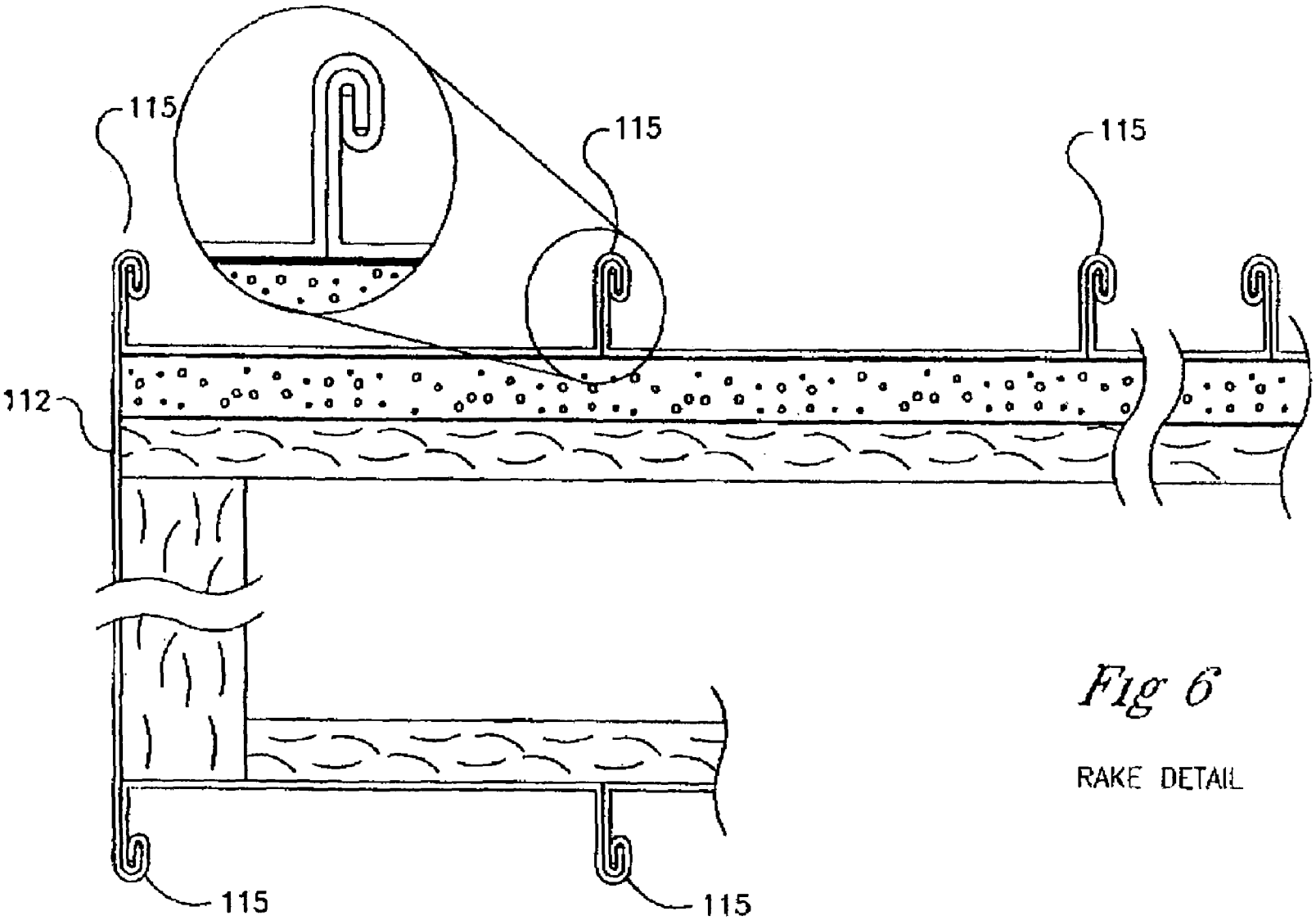
FIG. 6 is a cross-section view of a roof rake.
Figure 7:
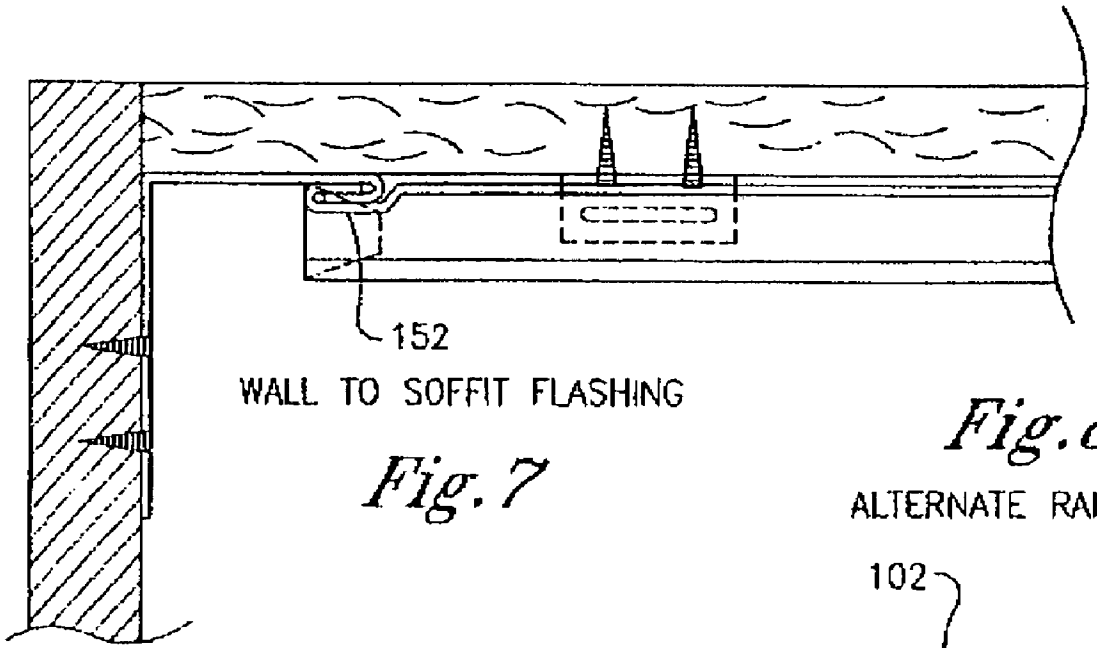
FIG. 7 is a cross-section view of a wall-to-soffit flashing detail.

In FIG. 6, the detail of roof panel 102 and roof rake 112 is shown. Note that the seams joining roof panels 102 to each other and to the roof rake 112 are double lock seams 115.

Figure 8:
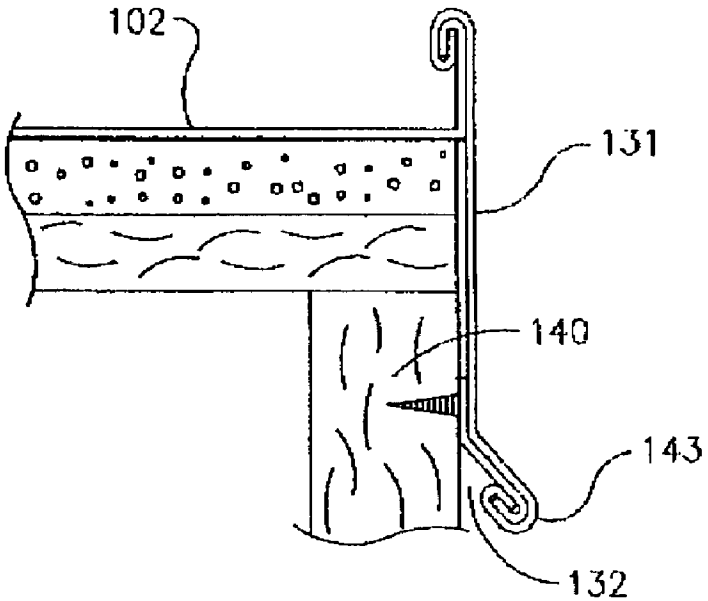
FIG. 8 is a cross-section view of an alternate roof rake.

In FIG. 8, an alternate embodiment of the seaming between a roof panel 102 and the fascia 131 is shown, where the fascia 131 terminates before wrapping under the roof 140. This fascia 131 arrangement is held down to the roof by means of a bracket 132 made of the same metal as the roof panels 102, joined to the roof rake 131 by means of a double lock seam 143.

As shown in FIGS. 4, 5A-C, and 6, the method of the present invention can be applied to all areas of the roof 100 where metal roof panels 102 encounter each other or building fascia 111. A fascia clip 160 is first attached to the building substrate. A fascia clip seam 151 is formed between the fascia section 111 and the fascia clip 160. A soffit seam 162 is formed where the fascia section 111 engages a soffit section (is applicable). The pan sections 102 are attached to the fascia section 111 with an eaves seam 161. As should be apparent, all of the roof elements and sections are sealed together to provide a water-proof and supremely wind-resistant building roof.

Figure 9:
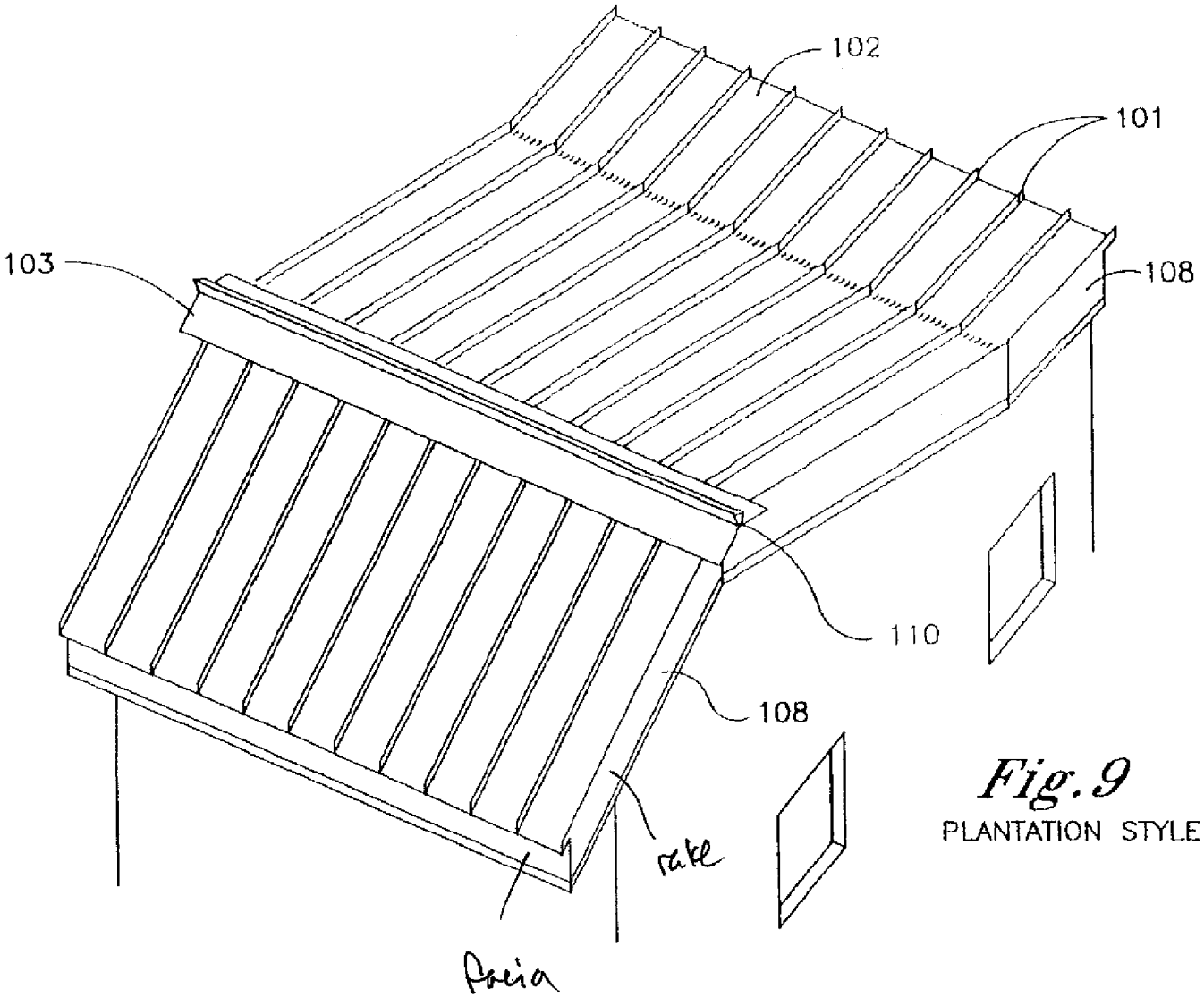
FIG. 9 is a plantation style roof installed using the present invention.

FIG. 9 shows a typical plantation-style roof made with the present invention. The break in roof slope is accommodated by means of folding the continuous metal roof parts.

Figure 10:
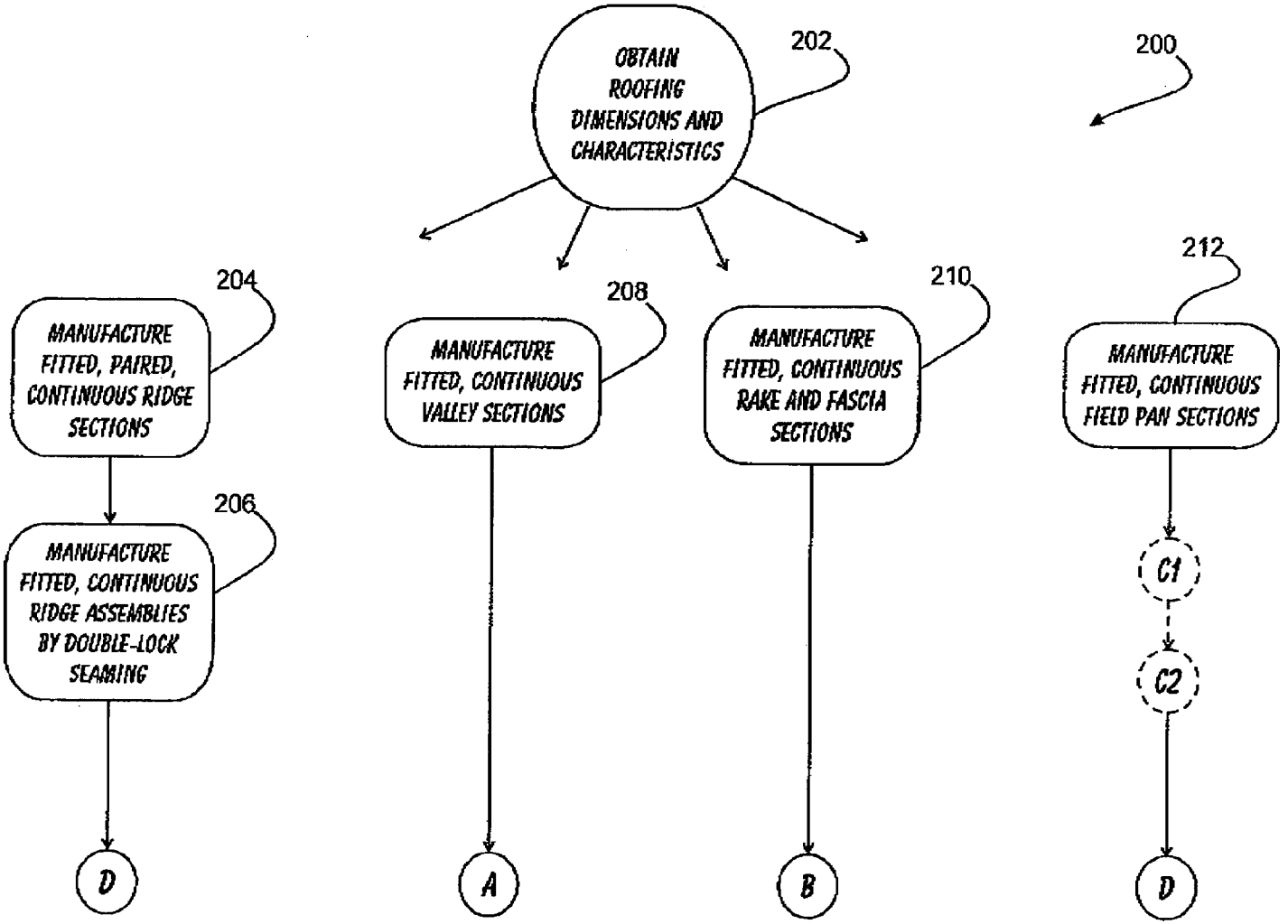
FIG. 10 is a flow chart depicting the initial steps involved in the roofing method of the present invention.

FIGS. 10-14 are presented in order to fully disclose the method of the present invention, as it compares to the prior art. FIG. 10 is a flow chart depicting the initial steps involved in the roofing method 200 of the present invention. In the interest of clarity, structural elements identified within the context of the following method steps will be enclosed in parenthesis (e.g. 103), which indicates that the element referenced can be found in a previously-identified drawing figure.

As with any conventional metal sheet roofing method, the dimensions and characteristics of the roof must be obtained 202. It should be understood that some of the dimensions can be obtained "on the fly," during installation, since the various pieces are all intended to be manufactured at the job site. Each "branch" of the subsequent method steps will be initiated in an order that is determined by the roof installation. For example, some roof installations may mandate rake/fascia manufacture and installation prior to valley installation, and vice versa. Consequently, the "branches" of the method are to be presumed to be independently executed from each of the other branches.

The ridge manufacture "branch" begins with the manufacturing of fitted, paired, continuous ridge sections 204. The ridge sections (104) and (105) are depicted above in FIG. 3. Ridge sections will be custom made to size for each ridge in the roof.

Once the ridge sections (104, 105) are manufactured (or as pairs are manufactured), fitted, continuous ridge assemblies (103) are created by forming a double-lock seam (110) between the two ridge sections (104, 105). The completed ridge assemblies (103) will be devoid of any breaks, patches, splices or other discontinuities, making them particularly weather- and wind-proof. Reference numeral D is to be followed upon completion of all of the remaining "branches" in the method 200.

The method 200 further includes the manufacture of fitted, continuous valley sections 208. Again, these can be pre-manufactured, or made on-the-fly. Following reference numeral A to FIG. 11, we can continue with this branch of the method 200.

Figure 11:
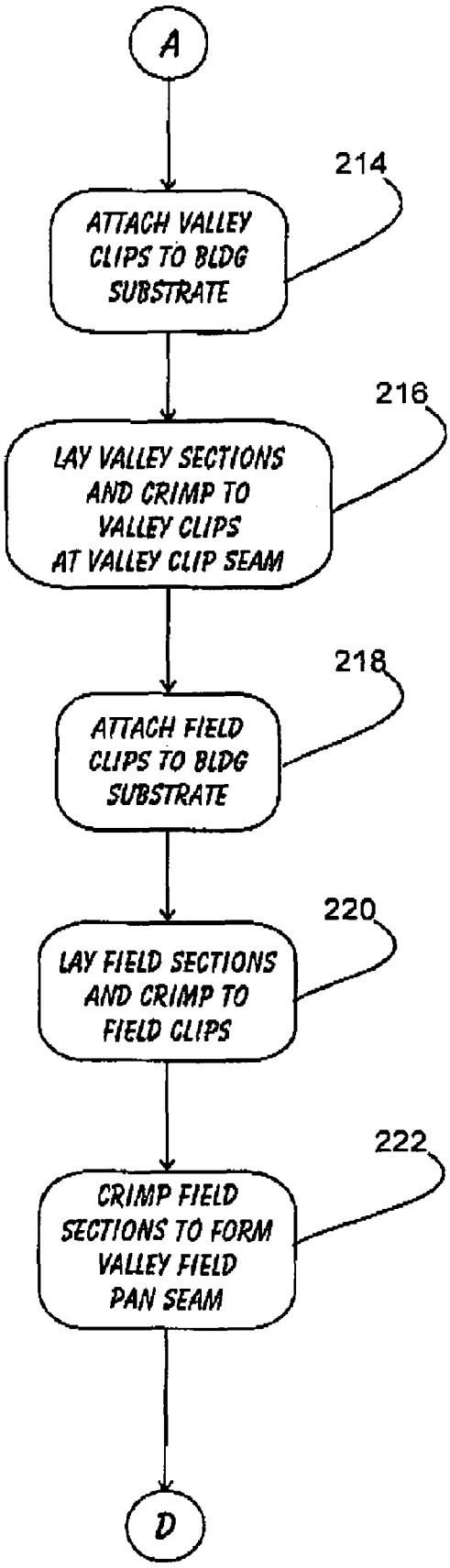
FIG. 11 is a flowchart depicting the method steps for installation of the valley section.

FIG. 11 is a flowchart depicting the method steps for installation of the valley section. The structural elements discussed within in the context of this method are depicted in FIG. 5, above.

First, valley clips are attached to the building substrate 214. Next, valley sections are laid out and crimped to the valley clips at the valley clips seam 216. As discussed above, the valley clip seam is separate from the seam that interconnects the pan sections to the valley section.

Preferably next, field clips are attached to the building substrate 218. The field/pan sections (102) are laid out and crimped to the field clips 220. Finally, the field/pan sections (102) are crimped to the valley section (107) to form the valley field pan seam. Reference numeral D is to be followed upon completion of all of the remaining "branches" in the method 200.

The method 200 further includes the manufacture of fitted, continuous rake and fascia sections 210. These can be pre-manufactured, or made on-the-fly. Following reference numeral B to FIG. 12, we can continue with this branch of the method 200.

Figure 12:
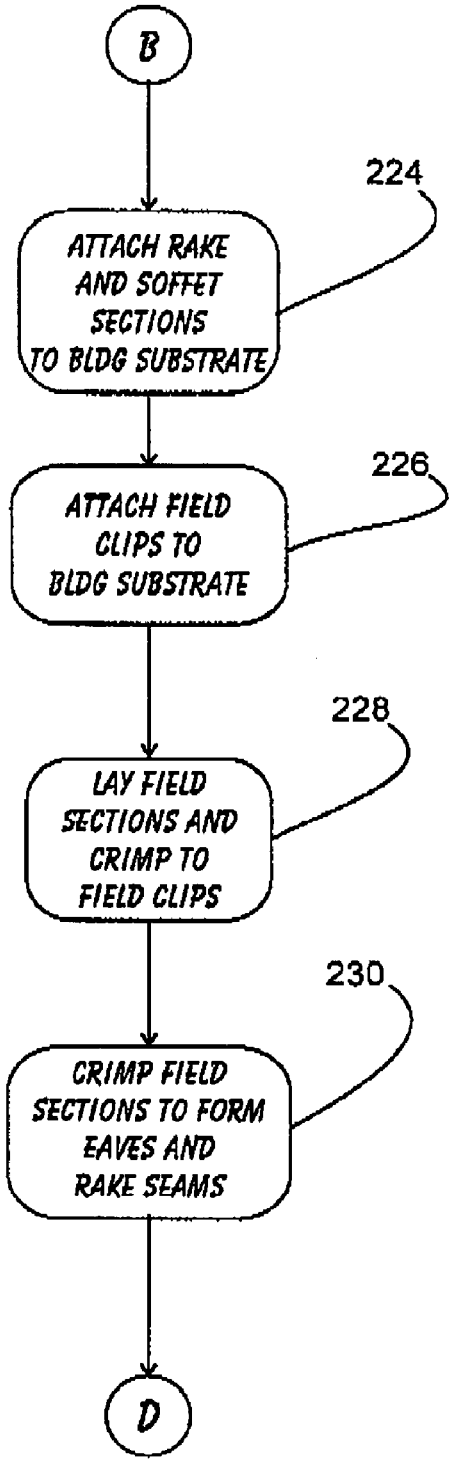
FIG. 12 is a flowchart depicting the method steps for installation of the soffit and rake sections.

FIG. 12 is a flowchart depicting the method steps for installation of the soffit and rake sections. The structural elements are depicted above in FIG. 4. The rake (111) and soffit sections are attached to the building substrate 224. Again, field clips are attached to the building substrate 226 and the field/pan sections (102) are laid out and crimped to the field clips 228. Finally, the field sections (102) are crimped to the rake section (111) to form the rake seams and eave seams 230. Reference numeral D is to be followed upon completion of all of the remaining "branches" in the method 200.

Figure 13:
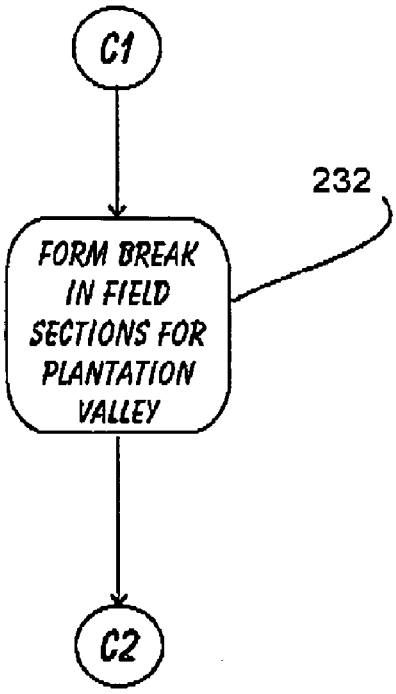
FIG. 13 is the optional step of modifying the field pans for installation on a plantation roof.

Each of the pan sections are formed in fitted, continuous pieces 212. Reference numerals C1 and C2 refer to the situation where a plantation roof meets the rest of the building roof structure. FIG. 13 is the optional step of modifying the field pans for installation on a plantation roof. As shown above in FIG. 9, breaks are formed in field sections prior to their installation on the roof 232 so that, once installed, a valley will be created at the junction of the plantation roof with the conventional pitched roof. Reference numeral D is to be followed upon completion of all of the remaining "branches" in the method 200.

Figure 14:
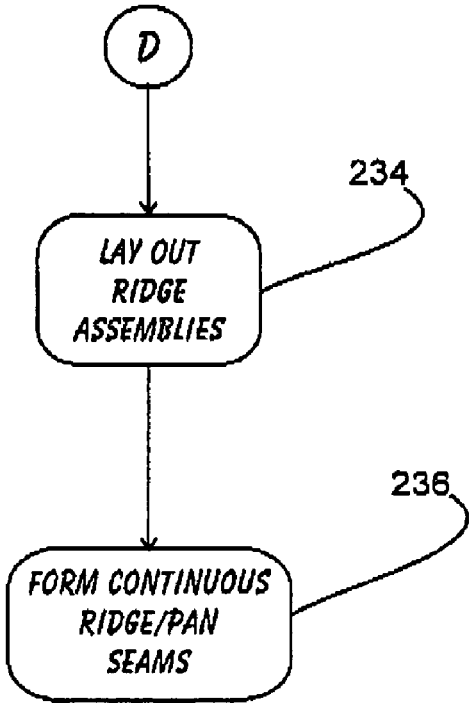
FIG. 14 depicts the method steps to complete the ridge assembly installation.

Finally, once all branches of the method 200 are complete, FIG. 14 depicts the method steps to complete the ridge assembly installation. FIG. 3, above, depicts the structure of the installed ridge area of the roof. The ridge assemblies are laid out in their respective locations 234, and continuous ridge/pan seams are formed between the pan sections (102) and the ridge assemblies (103).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of assembling metal roofs for buildings with a split pitch roof ridge to minimize wind and water damage to the building, the method comprised of the steps of:

mating a plurality of roof panels to each other with double lock seams, then mating the roof panels at the edges of the roof to a plurality of roof rake panels using double lock seams, then mating roof rake panels to fascia panels with double lock seams, then mating a roof ridge cap to the ridge cap end of the plurality of roof panels by means of double lock seams, the roof ridge cap formed with the method comprised of the steps of:

manufacturing a male lock panel and a female lock panel each in a continuous sheet of metal such that the male lock panel and the female lock panel are each as long as the roof ridge, the male lock panel and the female lock panel each possessing a seam edge and a roof panel edge, then joining the male lock panel to the female lock panel along the length of the two lock panels by means of a double lock seam at the seam edge of each of the male lock panel and the female lock panel, the double lock seam in each case formed by folding the seam edge of the female lock panel over the seam edge of the male lock panel once to form a single lock seam, then folding the single lock seam again to form a double lock seam.

2. The method of assembling metal roof for buildings with a split pitch roof ridge of claim 1 where the step of folding the seam edge of the female lock panel over the seam edge of the male lock panel is performed by means of hand tools, selected from the group of pliers, needle-nose pliers, hand seamers, and wooden mallets.

3. The method of assembling metal roofs for buildings with a split pitch roof ridge of claim 1 where the metal roofs are comprised of a metal selected from the group of copper, steel, or aluminum.

4. A method of covering a building substrate with a metallic roof, comprising the steps of:

manufacturing fitted, continuous ridge assemblies;

manufacturing fitted, continuous valley sections;

manufacturing fitted, continuous rake and fascia sections;

manufacturing fitted, continuous field pan sections;

attaching said valley sections to the building substrate, whereby each substrate valley is covered by a single, fitted said valley section;

attaching said rake and fascia sections to the building substrate, whereby each covered rake and fascia regions of the building substrate are covered by single, fitted said rake and fascia sections;

attaching said field pan sections to the building substrate;

crimping said valley, rake and fascia sections to adjacent field pan sections in double-locked or S-lock seams; and attaching said ridge assemblies to said field pan sections in double-locked or S-lock seams.

5. The method of claim 4, wherein said manufacturing continuous fitted ridge assemblies step comprises:

manufacturing fitted, paired, continuous ridge sections; and crimping said paired ridge sections to one another with a double-locked seam.

6. The method of claim 5, wherein said valley section attaching step comprises:

crimping said valley sections to valley clips to form a valley clip seam;

crimping said field pan sections to said valley sections to form a valley field pan seam between each said crimped field pan section and valley section.

7. The method of claim 6, wherein said valley clips are attached to the building substrate.

8. The method of claim 7, wherein said field pan sections are crimped to field clips prior to said formation of said valley field pan seams.

9. The method of claim 8, wherein said field clips are attached to the building substrate.

10. The method of claim 9, wherein said valley field pan seams are in spaced relation along said valley sections with said valley clip seams.

11. The method of claim 10, wherein said ridge assembly attaching step comprises the formation of continuous, S-shaped or double-lock seams between said adjacent field pan sections and said ridge assemblies.

12. The method of claim 6, wherein said ridge assembly attaching step comprises the formation of continuous, S-shaped or double-lock seams between said adjacent field pan sections and said ridge assemblies.

* * * * *